US010214412B2

(12) United States Patent
Benetti

(10) Patent No.: US 10,214,412 B2
(45) Date of Patent: Feb. 26, 2019

(54) STIRRUPS FOR HORSEBACK RIDING

(71) Applicant: ACAVALLO S.r.l., Lonato del Garda, Brescia (IT)

(72) Inventor: Mauro Benetti, Brescia (IT)

(73) Assignee: ACAVALLO S.R.L., Lonato del Garda (Brescia) (IT)

( * ) Notice: Subject to any disclaimer, the term of this patent is extended or adjusted under 35 U.S.C. 154(b) by 64 days.

(21) Appl. No.: 14/824,186

(22) Filed: Aug. 12, 2015

(65) Prior Publication Data

US 2016/0046481 A1 Feb. 18, 2016

(30) Foreign Application Priority Data

Aug. 14, 2014 (IT) ..... BS2014A0150

(51) Int. Cl.
*B68C 3/00* (2006.01)

(52) U.S. Cl.
CPC ..... *B68C 3/00* (2013.01); *B68C 2003/005* (2013.01); *B68C 2003/0083* (2013.01)

(58) Field of Classification Search
CPC ... B68C 3/00; B68C 3/0016; B68C 2003/006; B68C 2003/0083; B68C 2003/0091; B68C 3/025
USPC ..... 54/47
See application file for complete search history.

(56) References Cited

U.S. PATENT DOCUMENTS 38,995 A * 6/1863 Towers ..... B68C 3/00 54/47
44,292 A * 9/1864 Eagle ..... B68C 3/00 54/47
50,007 A * 9/1865 Irion ..... B68C 3/02 54/49
259,101 A * 6/1882 Cox ..... B68C 3/0016 54/49
567,334 A * 9/1896 Chilcott ..... B68C 3/00 54/47
4,995,226 A * 2/1991 Kuhn, Jr. ..... B68C 3/02 54/49
5,398,488 A * 3/1995 Brown ..... B68C 3/00 54/47
6,216,427 B1 * 4/2001 Cupp ..... B68C 3/00 54/47

(Continued)

FOREIGN PATENT DOCUMENTS

DE 8530209 U1 3/1986
EP 1961695 A1 8/2008

(Continued)

OTHER PUBLICATIONS

English-language translation of FR 321,849.*

*Primary Examiner* — Lisa L Tsang
(74) *Attorney, Agent, or Firm* — Robert E. Alderson, Jr.

(57) ABSTRACT

Stirrups for horseback riding which include a tread for the support of the foot and an arched structure that extends from the ends of the tread for connection to a stirrup strap. The arched structure may be formed by two stirrup arms, each forming, in a single body with said arm, a half-ring lying in a plane substantially orthogonal to the plane in which said arched structure lies. The half-rings of said stirrup arms are brought together with each other to form a stirrup ring suitable for being passed through by the stirrup strap.

7 Claims, 3 Drawing Sheets

(56) References Cited

U.S. PATENT DOCUMENTS

| | | | | |
|---|---|---|---|---|
| 2005/0076620 | A1* | 4/2005 | Sjosward | B68C 3/02 54/48 |
| 2009/0178375 | A1* | 7/2009 | Benetti | B68C 3/00 54/49 |
| 2009/0266039 | A1* | 10/2009 | Gottlieb | B68C 3/02 54/47 |
| 2010/0300050 | A1* | 12/2010 | Vollmecke | B68C 3/00 54/47 |
| 2014/0053516 | A1* | 2/2014 | Harvey | B68C 3/00 54/49 |
| 2015/0284238 | A1* | 10/2015 | Braun | B68C 3/025 54/47 |
| 2015/0329350 | A1* | 11/2015 | Bowe | B68C 3/00 54/47 |

FOREIGN PATENT DOCUMENTS

| | | | |
|---|---|---|---|
| FR | 321849 | A | 1/1903 |
| FR | 2956108 | A1 | 8/2011 |

* cited by examiner

STIRRUPS FOR HORSEBACK RIDING

CROSS REFERENCE TO RELATED APPLICATION

This application claims priority to and benefit of Italian Patent Application No. BS2014A000150 (which corresponds to Italian Patent Application No. 102014902287716 under the new numbering system which was introduced in 2015 with the implementation of the IPTO online filing platform) filed Aug. 14, 2014, the contents of which are incorporated by reference in their entirety.

FIELD OF THE INVENTION

This invention relates to stirrups for horseback riding.

BACKGROUND OF THE INVENTION

A stirrup for horseback riding is generally formed by an annular structure having a lower horizontal portion, also referred to as a "tread", supporting the boot or shoe of the rider. Above, the stirrup is provided with a ring for connection to a stirrup strap.

Typically, the ring is loosely coupled to the annular structure. During use, when the foot of the rider is not inserted in the stirrup, the stirrup tends to be arranged parallel to the horse's body, making it difficult to insert the boot or shoe.

Sometimes the ring is formed as an opening in the top of the annular structure. Also in such cases, when the bracket hangs freely from the stirrup strap, it is substantially parallel to the body of the horse.

The ring also may be welded to the top of the arched structure of the stirrup. However, the weld involves a greater risk of breakage of the stirrup and requires, in any case, further features in order to make the stirrup.

SUMMARY OF THE INVENTION

The purpose of the present invention is to provide stirrups for horseback riding which allow comfortable and rapid insertion of boots or shoes and that are at the same time reliable, easy and economical to produce.

This purpose is achieved with stirrups for horseback riding as described and claimed herein.

Characteristics and advantages of stirrups according to the invention will be evident from the following description provided by way of non-limiting examples, with reference to the accompanying drawings.

DETAILED DESCRIPTION

Figure 2:
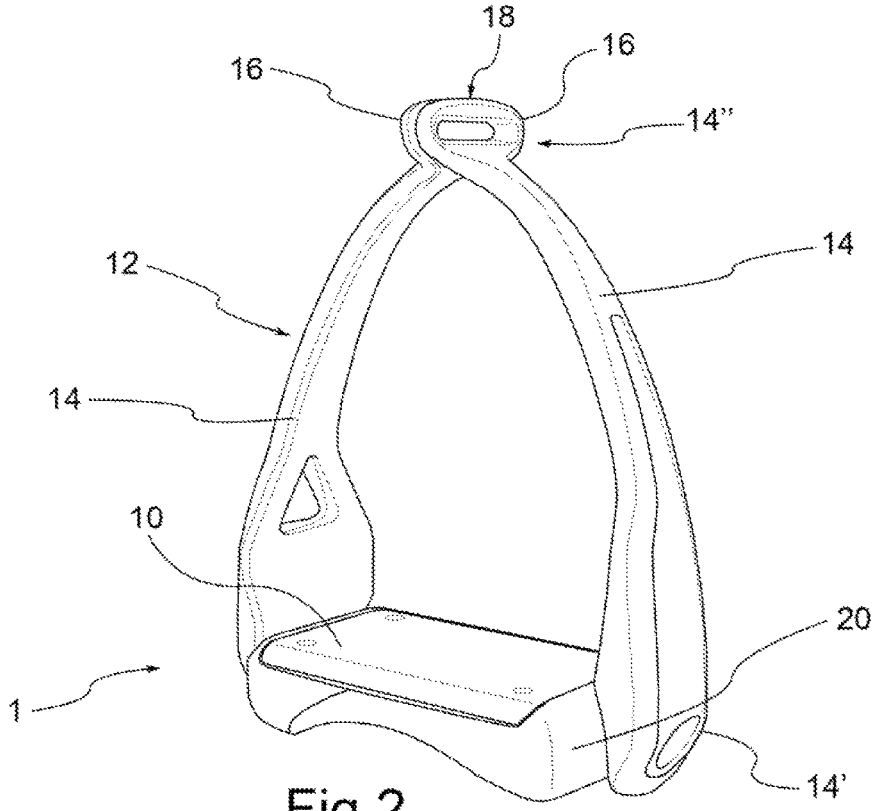
FIG. 2 is a perspective view of an assembled stirrup.
Figure 1:
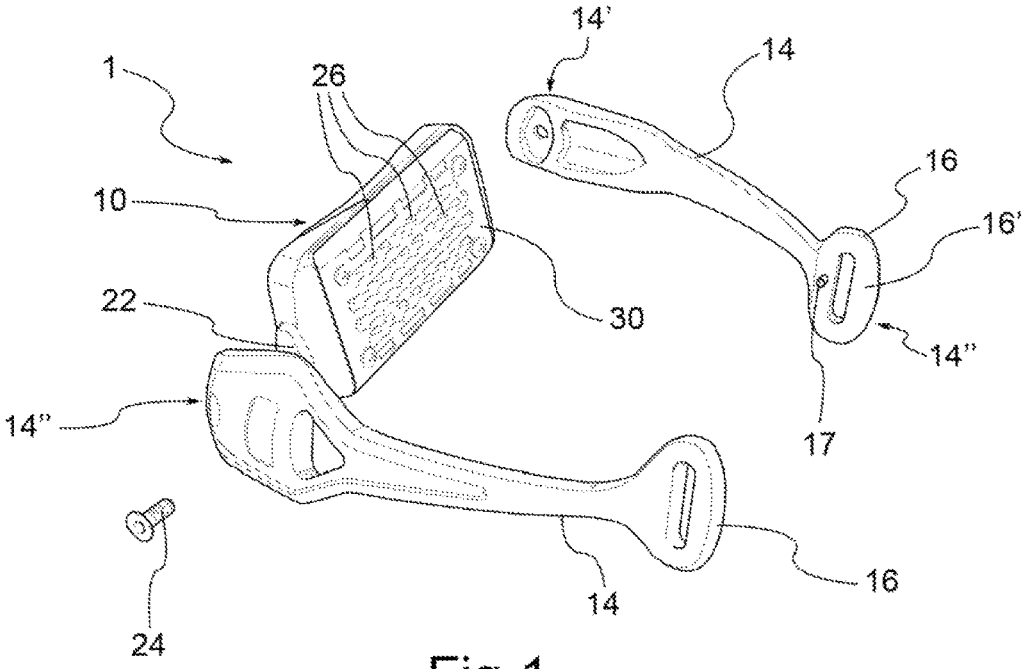
FIG. 1 is an exploded perspective view of a stirrup according to an embodiment of the invention.
Figure 3:
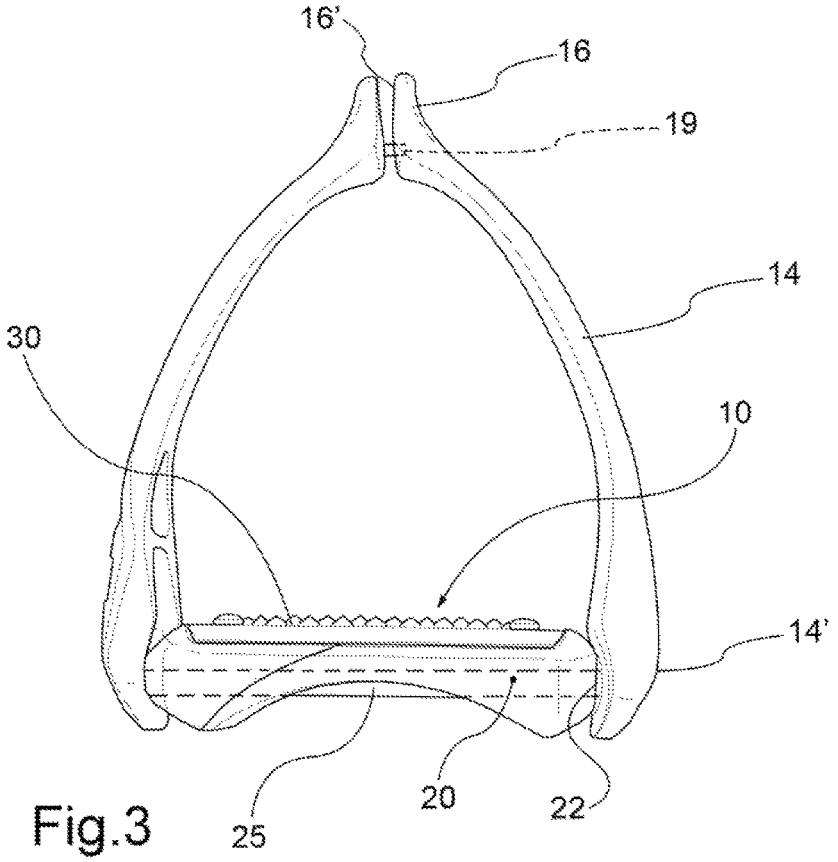
FIG. 3 is a front view of the stirrup.

In the drawings, reference number 1 generally denotes a stirrup according to embodiments of the invention as a whole. The stirrup 1 includes a tread 10 for the support of the foot of the rider and an arched structure 12 that extends from the ends of the tread for connection to a stirrup strap.

The arched structure 12 is formed by two stirrup arms 14. Each stirrup arm 14 has a lower end 14' connected to a respective end of the tread 10 and an upper end 14" forming, in a single body with said arm 14, a closed annular half-ring 16. This closed annular half-ring 16 lies in a plane substantially orthogonal to the plane in which the arched structure 12 lies. The closed annular half-rings 16 of the stirrup arms 14 are brought together with each other to form a stirrup ring 18 suitable for being passed through by the stirrup strap.

In certain embodiments, the two closed-annular half-rings 16 are the same as each other and are juxtaposed in a vertical median plane of the stirrup 1.

In certain embodiments, each closed annular half-ring has a flat lateral surface 16' facing the other closed annular half-ring 16. In this way, the two closed annular half-rings 16, when juxtaposed, come into contact with the respective flat lateral surfaces 16', obtaining a very stable coupling of the two arms of the stirrup. In certain embodiments, to facilitate the mutual centering of the two stirrup arms, the two closed annular half-rings 16 are provided with complementary coupling elements. For example, a closed annular half-ring 16 may have a centering pin 17 that extends perpendicularly from the flat lateral surface 16' to be inserted into a corresponding hole 19 formed in the flat lateral surface 16' of the other closed annular half-ring.

In certain embodiments, the stirrup arms 14 may be made by moulding, for example, in a plastic material.

In certain embodiments, the two stirrup arms 14 have a different shape, in particular in the vicinity of their lower end 14'. For example, the stirrup arm nearest the body of the horse may have a smaller width so as to minimise rubbing with the body of the horse, while the farther stirrup arm may have a greater width to improve the stability and containment effect and to guide the foot of the rider.

In addition, the two stirrup arms 14 may be made with materials and/or dimensions such that each respective stirrup arm has a different breaking point, so as to facilitate extraction of the foot from the stirrup in the event of an accident.

In certain embodiments, the tread 10 includes a tread body 20 made by moulding, for example, in a plastic material.

In certain embodiments, the stirrup arms 14 are screwed to the tread 10. For example, two threaded bushings 22 are embedded in the body of the stirrup 20 in which attachment screws 24 are screwed to attach the stirrup arms 14 to the tread body 20. For example, said threaded bushings 22 may be formed of threaded tubular ends of a metal bar 25 that passes from one lateral end to the other of the tread body 20.

The use of a metal bar 25 that passes through the tread 10 makes the structure of the stirrup and, in particular, of the tread, more solid, especially when the thread is made of plastic material. In addition, the metal bar 25 in the tread lowers the centre of gravity of the stirrup, making it easier to reposition the foot inside the arch of the stirrup during advancement of the horse at various gaits, such as from walk to trot, trot to canter and canter to gallop.

In certain embodiments, the tread 10 may be crossed by a plurality of emptying passages 26 suitable for allowing the passage of dirt, such as mud, from the sole of the boot or shoe towards the ground.

In certain embodiments, the tread 10 may include a knurled plate 30 for the support of the boot or shoe. For example, knurled plate 30 may be screwed to the tread body 20 and also be crossed by holes corresponding to emptying passages 26.

Figure 4:
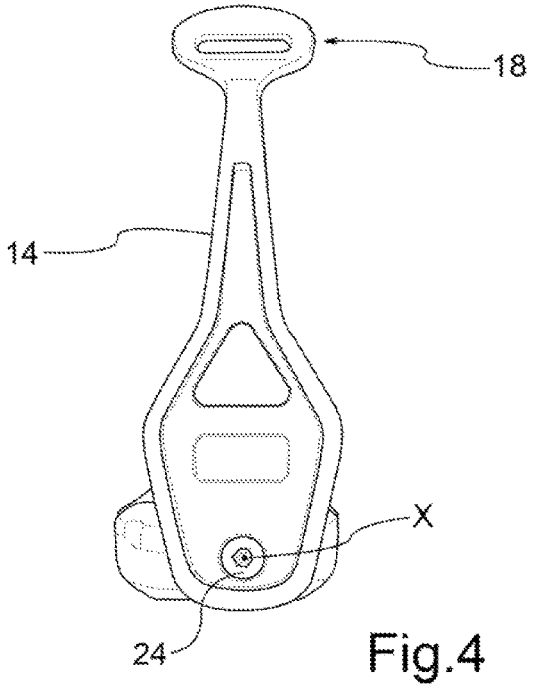
FIG. 4 is a side view of the stirrup.
Figure 5:
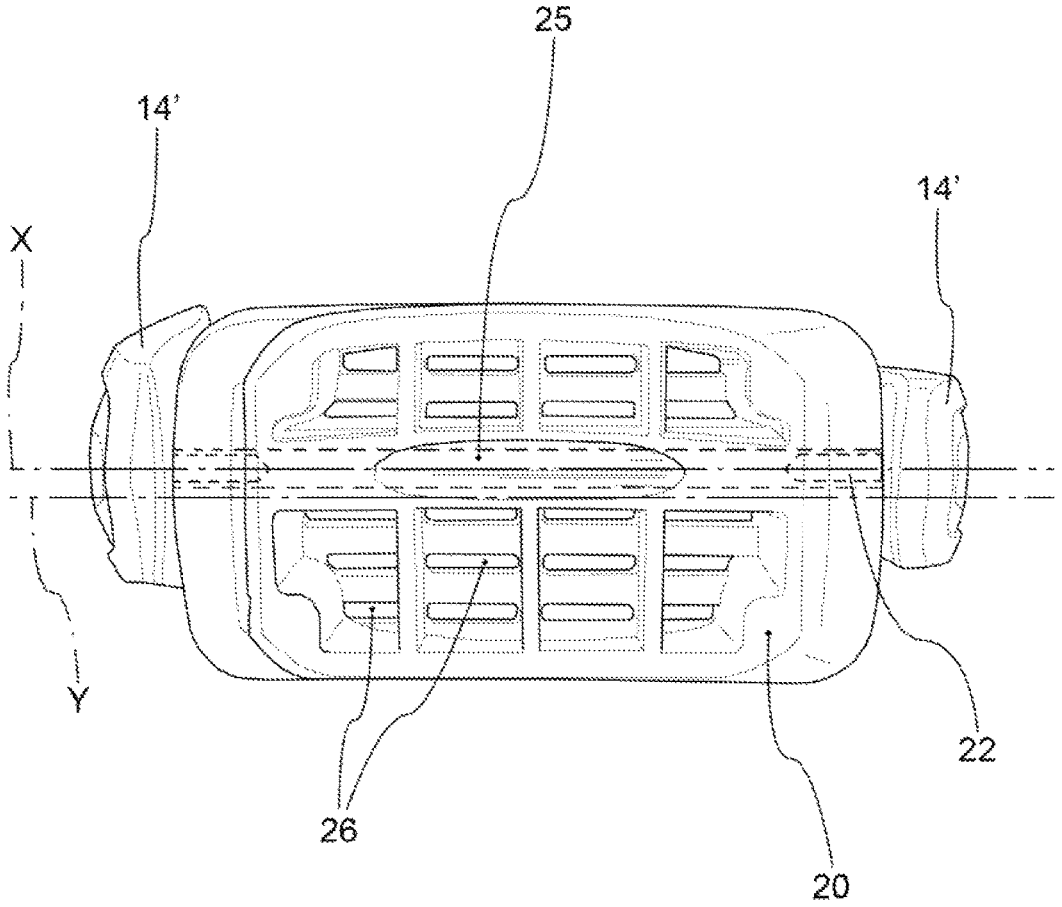
FIG. 5 is a plan view from below of the stirrup.

In one embodiment, illustrated particularly by FIGS. 4 and 5, the axis X that connects the lower ends 14' of the stirrup arms 14, i.e., coaxial to the attachment screws 24, may be parallel and further forward than the median horizontal axis Y of the tread 10. Such an asymmetric structure of the tread 10 with respect to the annular structure 12 facilitates the support of the boot or shoe on the tread.

Moreover, in certain embodiments, the tread 10 may be inclined relative to a horizontal plane, so that the rear part is lower than the front part. This configuration of the tread 10 also facilitates the support of the boot or shoe on the tread and can make riding safer and more comfortable.

For example, such an inclination of the tread 10 may be obtained by appropriately shaping the coupling ends of the tread and the stirrup arms.

The orientation of the stirrup ring 18 perpendicular to the arched structure 12 ensures that, when the stirrup hangs freely from the stirrup strap, it lies orthogonally to the body of the horse, i.e., with its maximum opening in the direction of the toe of the boot or shoe of the rider.

Thanks to the realisation of the curved structure in two arms, each defining part of the ring in a single body, by, for example, molding, stirrups of the present invention are particularly simple and economical to produce. The small number of parts making up such stirrups, and the absence of welds also make it reliable, robust and attractive from an aesthetic point of view.

A skilled person may make certain modifications to the present invention based on the description and drawings without departing from the scope of the invention. Each of the characteristics described above as belonging to a possible embodiment may be achieved independently from the other embodiments described herein.

What is claimed is:

1. A stirrup for horseback riding, comprising a tread for supporting a foot, the tread comprising lateral ends, and an arched structure which extends from the lateral ends of the tread for connection to a stirrup leather, said arched structure comprising two stirrup arms, each of the stirrup arms having a lower end connected to a respective lateral end of the tread and an upper end forming, in a single body with said stirrup arm, a closed annular half-ring lying in a plane substantially orthogonal to a plane in which said arched structure lies, the two closed annular half-rings of said stirrup arms being juxtaposed so as to form a stirrup ring suitable for being crossed by the stirrup leather, wherein the tread comprises a tread body made by molding and wherein the stirrup arms are screwed to the tread;

wherein two threaded bushings are embedded in the tread body in which attachment screws are screwed to attach the stirrup arms to the tread body, wherein each of the stirrup arms is formed by molding of plastic materials;

wherein one of the two stirrup arms that is nearest the body of a horse has a smaller width than the other stirrup each of the stirrup arms has a different shape in a vicinity of their respective lower ends; and wherein each of the stirrup arms has a different breaking point, so as to facilitate extraction of the foot from the stirrup.

2. The stirrup of claim 1, wherein each of the two closed annular half-rings has a flat lateral surface facing the other of the closed annular half-ring.

3. The stirrup of claim 1, wherein said stirrup arms are made by molding.

4. The stirrup of claim 1, wherein said threaded bushings are formed of threaded tubular ends of a metal bar which crosses the tread between the lateral ends of the tread.

5. The stirrup of claim 1, wherein the tread is crossed by a plurality of emptying passages for allowing dirt to pass from a sole of a boot or shoe towards a ground.

6. The stirrup of claim 1, wherein the tread comprises a knurled plate for supporting a boot.

7. The stirrup of claim 1, wherein the tread defines a median horizontal axis (Y) of the tread, and wherein an axis (X) connecting the lower ends of the stirrup arms is parallel and further forward than the median horizontal axis (Y) of the tread.

* * * * *